US009359856B2

(12) United States Patent
Broussard

(10) Patent No.: US 9,359,856 B2
(45) Date of Patent: Jun. 7, 2016

(54) SWELLABLE PACKER IN HOOKUP NIPPLE

(75) Inventor: John Broussard, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1070 days.

(21) Appl. No.: 13/453,565

(22) Filed: Apr. 23, 2012

(65) Prior Publication Data

US 2013/0277052 A1 Oct. 24, 2013

(51) Int. Cl.
*E21B 33/12* (2006.01)
*E21B 43/04* (2006.01)

(52) U.S. Cl.
CPC ..... *E21B 33/1208* (2013.01); *E21B 43/04* (2013.01)

(58) Field of Classification Search
CPC ..... E21B 33/1208; E21B 43/04
See application file for complete search history.

(56) References Cited

U.S. PATENT DOCUMENTS

| | | | | |
|---|---|---|---|---|
| 3,710,862 | A * | 1/1973 | Young et al. | 166/278 |
| 4,089,548 | A * | 5/1978 | Gurley | 285/3 |
| 6,382,319 | B1 * | 5/2002 | Hill et al. | 166/278 |
| 6,873,267 | B1 * | 3/2005 | Tubel et al. | 340/853.3 |
| 2005/0000692 | A1 | 1/2005 | Cook et al. | |
| 2005/0092501 | A1 | 5/2005 | Chavers et al. | |
| 2008/0156496 | A1 * | 7/2008 | East | 166/313 |
| 2009/0159298 | A1 | 6/2009 | Assal | |
| 2011/0203793 | A1 | 8/2011 | Tibbles | |
| 2013/0277052 | A1 | 10/2013 | Broussard | |

FOREIGN PATENT DOCUMENTS

| | | | |
|---|---|---|---|
| RU | 2320859 | C1 | 3/2008 |
| WO | 2007092082 | A2 | 8/2007 |
| WO | 2011103038 | A1 | 8/2011 |

OTHER PUBLICATIONS

Examination Report received in corresponding Australian Application No. 2013200651, dated Apr. 30, 2014.
Official Action received in corresponding RU Application No. 2013118562 with translation.
Patent Examination Report No. 2 in counterpart Australian Appl. 2013200651, dated Oct. 12, 2015.

* cited by examiner

*Primary Examiner* — Giovanna C Wright
*Assistant Examiner* — Kristyn Hall
(74) *Attorney, Agent, or Firm* — Blank Rome LLP

(57) ABSTRACT

A screening assembly with a swellable packer incorporated onto the exterior of the screen that swells in the presence of water or hydrocarbons. The swellable packer swells at a rate that allows the gravel pack operation to proceed without hindering the gravel pack operation but then swells to seal the annular region around the exterior of a blank tubular at the upper end of the screen. By running in a swellable packer with the screen assembly at least one additional trip into the wellbore may be eliminated.

21 Claims, 5 Drawing Sheets

SWELLABLE PACKER IN HOOKUP NIPPLE

BACKGROUND

Hydrocarbon wells, horizontal wells in particular, typically have wellscreen sections having a perforated inner tube with an overlying screen portion. The purpose of the screen is to block the flow of particulate matter into the interior of the production tubing. Despite the wellscreen, some contaminants and other particulate matter still enter the production tubing. The particulate matter usually occurs naturally or is part of the drilling and production process. As the production fluids are recovered the particulate matter is also recovered at the surface. The particulate matter causes a number of problems in that the material is usually abrasive reducing the life of any associated production equipment. By controlling and reducing the amount of particulate matter that is pumped to the surface, overall production costs are reduced.

Even though the particulate matter may be too large to be produced, the particulate matter may cause problems at the downhole wellscreens. As the well fluids are produced the larger particulate matter is trapped in the filter element of the wellscreens. Over the life of the well as more and more particulate matter is trapped in the filter elements the filter elements will become clogged and restrict flow of the well fluids to the surface.

A method of reducing the inflow of particulate matter before it reaches the wellscreens is to pack gravel or sand in the annular area between the wellscreen and the wellbore. Packing gravel or sand in the annulus provides the producing formation with a stabilizing force to prevent any material around the annulus from collapsing to produce particulate matter and it also provides a pre-filter to stop the flow of particulate matter before it reaches the wellscreen.

In certain gravel packing operation a screen with a detachable member, a crossover tool, and packer are run into the wellbore together. Once the screens, crossover tool, and packer are properly located the packer is set so that it forms a seal between wellbore and the screen isolating the annular region above the packer from the annular region below the packer. The bottom of the screen is sealed so that any fluid that enters the screen should pass through the screening or filtering material.

The crossover tool has a port that directs all fluid flow from inside of the tubular to the outside of the tubular including the screens below the crossover. The crossover tool has a second port that allows fluid to flow from the interior area of the screen below the crossover tool to an annular area around the exterior of the tubular but above the packer.

Once the packer is set, a slurry, usually containing gravel, may be pumped down the well through the tubular. When the slurry reaches the crossover tool it exits the crossover tool below the crossover tool and into the annular space created on the outside of the screen.

As the slurry travels from the top of the well toward the bottom along the outside of the screen the gravel is deposited as the transport fluid that carries the gravel drains to the inside of the screen. As the fluid drains into the interior of the screen it becomes increasingly difficult to pump the slurry down the wellbore. Once a certain portion of the screen is covered the gravel will start building back from the bottom towards the top to completely pack off the screen.

After the annular area around the screen has been packed with gravel then the operator releases the packer and crossover tool from the detachable member and reverses out. After the packer and crossover tool have been released a detachable member will remain as a reconnection point. The detachable member is required to allow the operator to reconnect to the liner before the well is put into service.

Generally, some type or mechanical packer or packoff mechanism is used to seal the annulus inside the well casing and outside of the liner so that all flow is directed through the gravel pack and into the liner. This prevents flow up the annulus which could remove the gravel pack sand from around the liner. Typically the packer is run in as a separate device that attaches to the detachable member with the production tubing attached above the packer. This assembly must be run into the well, attached to the liner and then mechanically or hydraulically actuated to seal the device to the annulus. The time to run these sealing mechanisms as well as the cost of these tools can be significant.

There exists, therefore, a significant need for an improved packer assembly for use in gravel pack operations that can eliminate additional trips downhole. The present invention fulfills these needs and provides further related advantages.

SUMMARY

In an embodiment of the invention a swelling packer element is incorporated onto the screen tubular above the screening section but below the detachable member. The swelling packer element typically has diameter that allows for freely circulating a gravel and sand slurry around the swelling packer elements exterior when run in and when initially installed in the well. Typically the swelling packer element does not swell sufficiently to form a seal between the tubular and the wellbore or casing until the gravel pack operation is complete.

A swelling packer element below the detachable member would eliminate the need to run a separate mechanical packer or packoff mechanism to seal the annulus inside the well casing and outside of the liner As used herein the terms "swellable"" means any material that increases in size in the presence of an activation fluid such as a hydrocarbon, water, a hybrid fluid, or other activation fluid.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
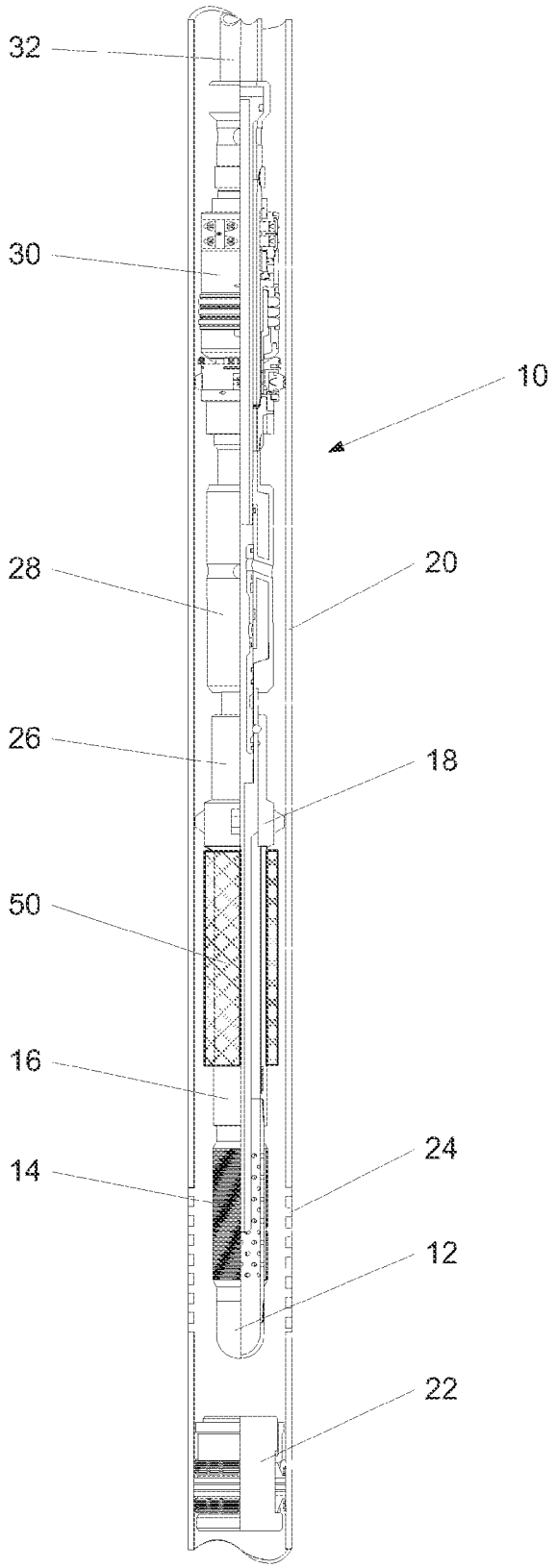
FIG. 1 depicts the wellbore assembly as it is run into a cased wellbore.

FIG. 1 depicts the wellbore assembly 10 as it is run into a cased wellbore 20. In the wellbore 20 shown a bridge plug 22 is shown in position at the bottom of the wellbore 20. The wellbore shown also has several perforations 24. The wellbore assembly 10 is typically assembled on the surface and consists of several subassemblies including a bull plug 12, a screen 14, a section of blank tubular 16, a centralizer 18, a detachable member 26, a crossover tool 28, a mechanical packer 30, a swellable packer 50 attached to the exterior of the section of blank tubular 16, and a tubular string 32. The detachable member 26 may include such variations as a shearable tubular or a hookup nipple.

Typically the swellable packer 50 is a swellable elastomer such as ethylene propylene diene monomer that swells in the presence of hydrocarbons, a blend of nitrile with super absorbing polymers (SAP) that swells in the presence of water, or a blend of ethylene propylene diene monomer with super absorbing polymers that swells in the presence of an activation fluid that could incorporate either a water or hydrocarbon base. Where the swellable elastomer is wrapped around the exterior of the blank base tubular 16.

As the wellbore assembly is run into the wellbore the bridge plug 22 in the wellbore 20 serves to locate the wellbore assembly 10 and to isolate the particular formation of interest adjacent to the perforations 24 from the lower portion of the wellbore 20. The bull plug 12 serves to guide the wellbore assembly 10 into the wellbore 20 while preventing the wellbore assembly 10 from hanging on any protrusions that might exist in the wellbore 20. The bull plug 12 also serves to seal the lower end of the screen 14 from the exterior of the screen 14 thereby forcing any fluid to flow through the screen 14 before entering the interior of the screen 14. During the initial run-in stage the packer has not yet swelled any appreciable amount.

Figure 2:
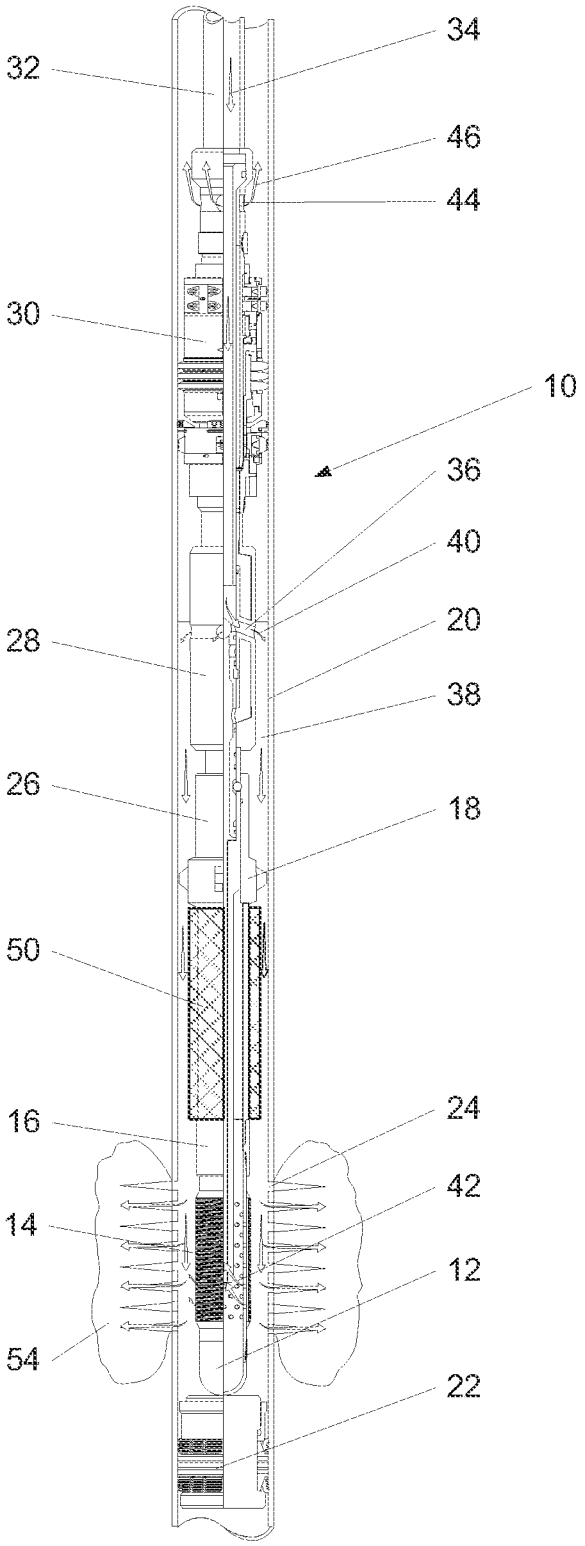
FIG. 2 depicts the wellbore assembly with the screen located adjacent to the perforations.

FIG. 2 depicts the wellbore assembly 10 with the screen 14 located adjacent to the perforations 24. With the screen 14 properly located the mechanical packer 30 may be set. Setting the mechanical packer 30, seals the wellbore 20 to the wellbore assembly 10 thereby isolating the wellbore 20 above the mechanical packer 30 from the wellbore 20 below the mechanical packer 30.

With the desired section of the wellbore 20 isolated the gravel packing operation may begin. A gravel slurry, depicted by directional arrow 34, is pumped down the tubular string 32. As the gravel slurry moves through the interior of the wellbore assembly 10, it moves through the interior of the mechanical packer 30 arriving at the crossover tool 28. At the crossover tool 28 and as depicted by directional flow arrow 40, the gravel slurry passes though ports 36 and moves into the annular region created by the wellbore 20, the wellbore assembly 10, the bridge plug 22, and the mechanical packer 30. During the gravel packing stage the swellable packer 50 has not yet swelled any appreciable amount and has a diameter that does not significantly impede the flow of gravel slurry as the gravel slurry flows from the crossover tool 28 down the annulus 38 towards the screen 14. The gravel slurry then moves towards the perforations 24, the formation 54, and the screen 14. Once the gravel slurry reaches the screens 14 the gravel is trapped in the annular region 38 while the transport fluid, as depicted by directional arrow 42, passes through the screen 14 and back into the interior of the screen 14, leaving the gravel 56 to fill in the annular region 38 adjacent to the screens 14. The transport fluid then moves upward towards the crossover tool 28. At the crossover tool 28 the transport fluid enters a passageway that isolates the transport fluid from the gravel slurry while allowing the transport fluid to flow upward through the interior of the mechanical packer 30. Once the transport fluid is above the mechanical packer 30 the passageway allows the transport fluid, as depicted by directional arrow 46, to pass through a port 44 connecting the passageway with an annular region between the wellbore 20 and the tubular string 32.

Figure 3:
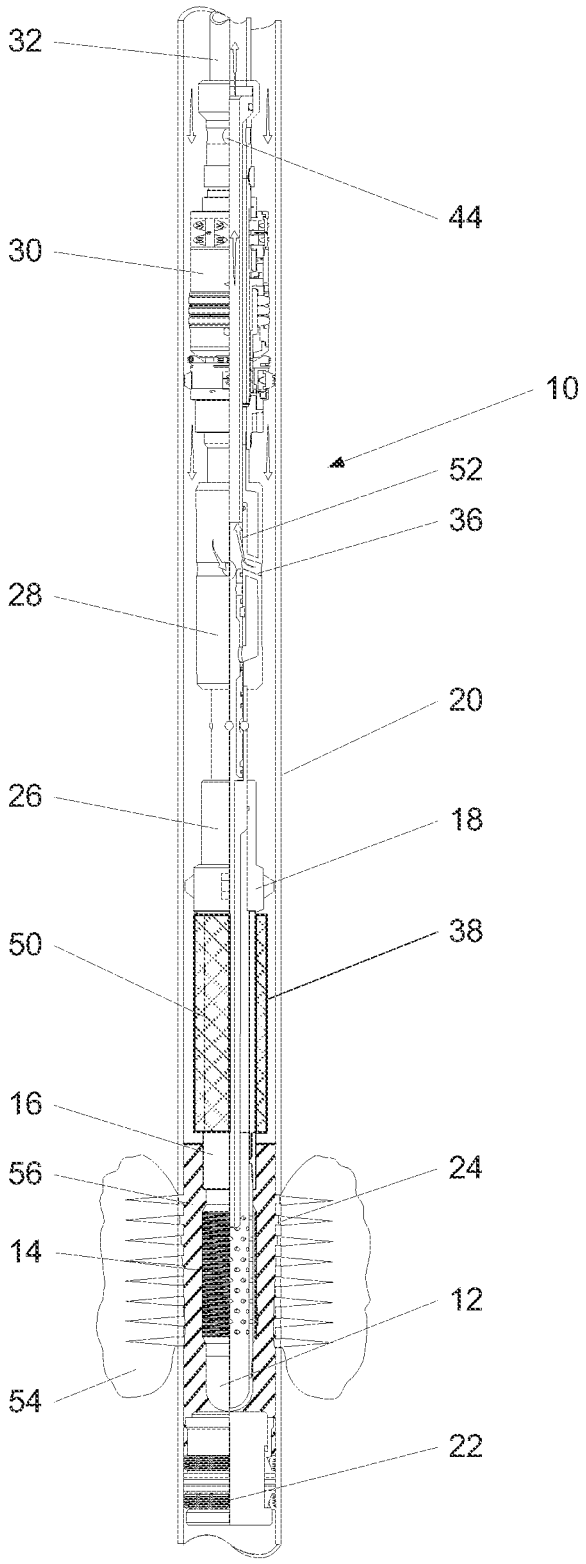
FIG. 3 depicts the wellbore and the wellbore assembly as the operator prepares to reverse out of the wellbore.

FIG. 3 depicts the wellbore 20 and the wellbore assembly 10 after the screen 14 has been packed with gravel 56 as the operator prepares to reverse out of the wellbore 20. In order to reverse out of the wellbore 20 the mechanical packer 30 is first released so that fluid may now flow through the annular region between the wellbore 20 and the wellbore assembly 10 from below the mechanical packer 30 to above the mechanical packer 30. Fluid may be pumped past the mechanical packer 30 to the surface through the annulus between the tubular string 32 and the wellbore 20. The fluid flows through any accumulated gravel 56 and into the crossover tool 28 as indicated by directional arrow 52. As the fluid flows into the crossover tool through ports 36 the fluid picks up the excess gravel 56 and carries the gravel 56 to the surface. Fluid is pumped down the annulus until the required amount of excess gravel 56 has been flushed out of the well. Typically enough gravel 56 is removed so that the annular region adjacent to the swellable packer 50 is clear of gravel.

Figure 4:
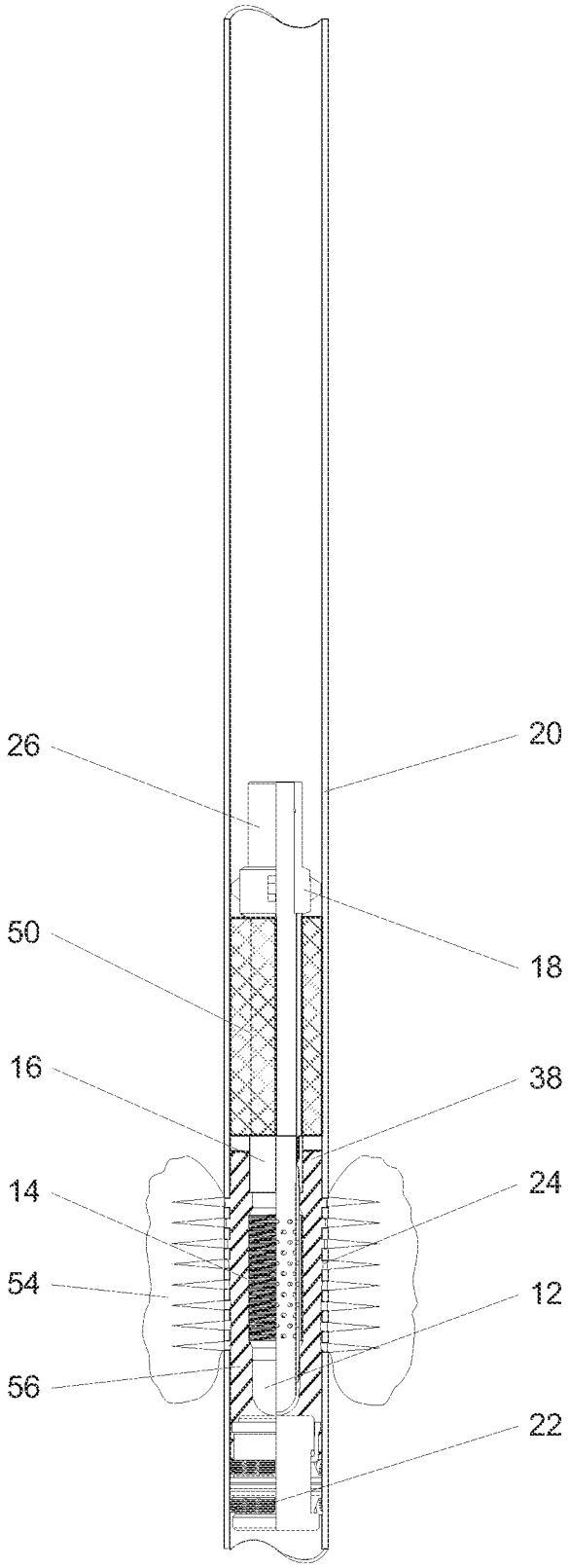
FIG. 4 depicts the portion of the wellbore assembly that remains in the wellbore.

FIG. 4 depicts the portion of the wellbore assembly that remains in the wellbore 20 after the operator reverses out of the wellbore 20. At some point in time after the crossover tool, the mechanical packer, and the tubular string are removed, the swellable packer 50 expands to fill the area between the wellbore 20 and the blank tubular 16 and adjacent to the swellable packer 50 thereby eliminating a trip into the wellbore 20 to place and activate a permanent packer. Once the swellable packer 50 has fully expanded the annular area 38 below the swellable packer 50 and the region above the swellable packer 50 are isolated from one another.

Figure 5:
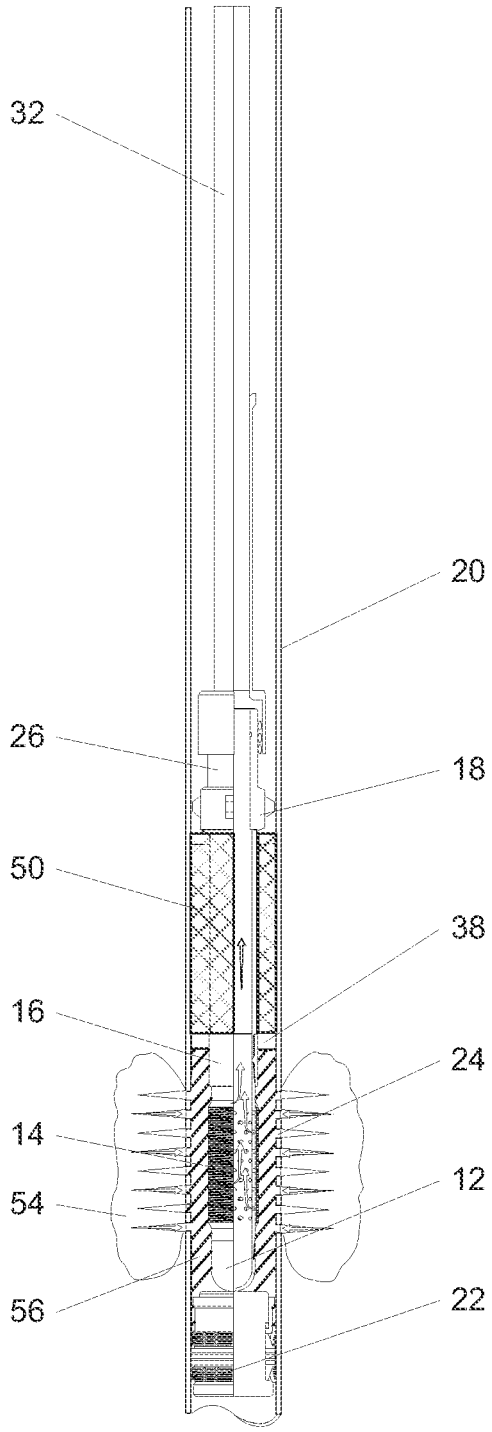
FIG. 5 depicts the completed gravel pack with the swellable packer 50 in its expanded state.

FIG. 5 depicts the completed gravel pack with the swellable packer 50 in its expanded state isolating the annular area above the swellable packer 50 from the annular area below the swellable packer 50. By preventing fluid flow past the swellable packer 50 any fluid produced from the formation 54 is forced to pass through the screens 14 before moving upward and into the tubular string 32 and then to the surface.

In certain instances such as when the reservoir pressure is low or depleted a pump may be added above the swellable packer to help lift the fluid and gas to the surface. The type of pump used will depend upon the particular application, but the pump could include an electric submersible pump, a rod driven pump such as a progressive cavity pump or barrel pump, or a gas lift pump may be used.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A wellbore screen assembly for use in a gravel pack operation in a wellbore, the wellbore screen assembly comprising:

a screen;

a section of blank tubular located above the screen;

a detachable member located above the section of blank tubular;

a mechanical packer located above the detachable member and configured to be set prior to commencing the gravel pack operation, remain set during the gravel pack operation, and be released upon completion of the gravel pack operation, wherein the mechanical packer may be removed from the wellbore by separation of the detachable member; and a swellable packer attached to the exterior of the section of blank tubular and configured to swell after removal of the mechanical packer upon completion of the gravel pack operation, thereby eliminating a trip into the wellbore to place and activate a permanent packer.

2. The wellbore screen assembly of claim 1 wherein the detachable member is a shearable member.

3. The wellbore screen assembly of claim 1 wherein the detachable member is a hookup nipple.

4. The wellbore screen assembly of claim 3 wherein an un-swollen diameter of the swellable material is about the same diameter as the hookup nipple.

5. The wellbore screen assembly of claim 1 wherein a swollen diameter of the swellable material seals a region between the section of blank tubular and an interior wall of the wellbore.

6. The wellbore screen assembly of claim 1 wherein the swellable material expands in the presence of an activation fluid.

7. The wellbore screen assembly of claim 6 wherein the activation fluid is water.

8. The wellbore screen assembly of claim 6 wherein the activation fluid is a hydrocarbon.

9. The wellbore screen assembly of claim 1 wherein the swellable material is a swellable elastomer.

10. A method of gravel packing a wellbore, the method comprising:

running into the wellbore a wellbore screen assembly comprising a screen, a section of blank tubular located above the screen and having a swellable packer attached thereto, a detachable member located above the section of blank tubular; and a mechanical packer located above the detachable member;

setting the mechanical packer;

performing a gravel pack operation on a section of the wellbore below the mechanical packer;

upon completion of the gravel pack operation, releasing the mechanical packer and removing the mechanical packer from the wellbore by separation of the detachable member;

after removing the mechanical packer from the wellbore, allowing the swellable packer to swell in response to the presence of wellbore fluids, thereby eliminating a trip into the wellbore to place and activate a permanent packer.

11. The method of claim 10 wherein the swellable packer is made from a swellable material comprising an elastomer.

12. The method of claim 10 wherein the detachable member is a hookup nipple.

13. The method of claim 12 wherein an un-swollen diameter of the swellable material is about the same diameter as the hookup nipple.

14. The method of claim 12 wherein a swollen diameter of the swellable material seals a region between the section of blank tubular and an interior wall of the wellbore.

15. The method of claim 10 wherein the detachable member is a shearable member.

16. The method of claim 10 wherein the swellable material expands in the presence of an activation fluid.

17. The method of claim 16 wherein the activation fluid is water.

18. The method of claim 16 wherein the activation fluid is a hydrocarbon.

19. A wellbore screen assembly for use in a gravel pack operation in a wellbore, the wellbore screen assembly comprising:

a screen;

a detachable member located above a section of blank tubular;

a releasable packer located above the detachable member and configured to be set prior to commencing the gravel pack operation, remain set during the gravel pack operation, and be released upon completion of the gravel pack operation, wherein the releasable packer may be removed from the wellbore by separation of the detachable member; and means for sealing the annulus above the screen after removal of the releasable packer upon completion of the gravel pack operation without a trip into the wellbore to place and activate a permanent packer.

20. The wellbore screen assembly of claim 19 wherein the means for sealing the annulus comprises a packer made from a swellable elastomer.

21. The wellbore screen assembly of claim 19 wherein the releasable packer is a mechanical packer.

* * * * *